US010082258B2

(12) United States Patent
He

(10) Patent No.: US 10,082,258 B2
(45) Date of Patent: Sep. 25, 2018

(54) VINE LAMP AND PRODUCTION METHOD THEREOF

(71) Applicant: Guangzhou Kingyi Metal Product Co., Ltd., Guangzhou (CN)

(72) Inventor: Yaowen He, Ganzhou (CN)

(73) Assignee: SHANGYOU JIAYI LIGHTING PRODUCT CO., LTD., Ganzhou (CN)

( * ) Notice: Subject to any disclaimer, the term of this patent is extended or adjusted under 35 U.S.C. 154(b) by 0 days.

(21) Appl. No.: 14/885,713

(22) Filed: Oct. 16, 2015

(65) Prior Publication Data

US 2017/0108185 A1 Apr. 20, 2017

(30) Foreign Application Priority Data

Oct. 14, 2015 (CN) ..... 2015 1 0664702

(51) Int. Cl.
*F21S 4/10* (2016.01)
*F21V 23/00* (2015.01)
(Continued)

(52) U.S. Cl.
CPC ..... *F21S 4/10* (2016.01); *F21V 3/00* (2013.01); *F21V 23/001* (2013.01); *F21S 4/15* (2016.01);
(Continued)

(58) Field of Classification Search
CPC ..... F21S 4/10; F21S 4/15; F21S 4/20; F21S 4/22; F21S 4/24; F21S 4/26
See application file for complete search history.

(56) References Cited

U.S. PATENT DOCUMENTS 638,895 A * 12/1899 Wallis ..... F21S 4/10 248/158
1,758,982 A * 5/1930 Seghers ..... F21S 4/10 200/2
(Continued)

FOREIGN PATENT DOCUMENTS

CN 1209633 A 3/1999
CN 2462226 Y 11/2001
(Continued)

OTHER PUBLICATIONS

DE Office Action for related application 10 2015 117 704.8 dated Sep. 13, 2016.
(Continued)

*Primary Examiner* — Alexander Garlen
*Assistant Examiner* — Colin Cattanach
(74) *Attorney, Agent, or Firm* — Symbus Law Group, LLC; Clifford D. Hyra

(57) ABSTRACT

A vine lamp and a production method thereof, the lamp including plural light strings, each of which includes a plurality of light emitting components and two conducting wires arranged side by side, wherein the insulating layer of each conducting wire is provided with a plurality of openings, on each of which one light emitting component is welded; a transparent encapsulation layer is wrapped outside of each light emitting component to form a lamp bead; the conducting wire between two adjacent light beads is divided into a first conducting wire section, a second conducting wire section and a third conducting wire section in sequence; the first conducting wire section and the third conducting wire section on both sides of each lamp bead intersect and are winded with each other; a plurality of the second conducting wire sections of the plurality of light strings intersect and are winded with each other.

10 Claims, 5 Drawing Sheets

(51) Int. Cl.

| | |
|---|---|
| ***F21V 3/00*** | (2015.01) |
| *F21S 4/26* | (2016.01) |
| *F21S 4/20* | (2016.01) |
| *F21S 4/24* | (2016.01) |
| *F21S 4/22* | (2016.01) |
| *F21S 4/15* | (2016.01) |
| *F21W 121/00* | (2006.01) |
| *F21Y 115/10* | (2016.01) |

(52) U.S. Cl.
CPC .. *F21S 4/20* (2016.01); *F21S 4/22* (2016.01); *F21S 4/24* (2016.01); *F21S 4/26* (2016.01); *F21W 2121/00* (2013.01); *F21Y 2115/10* (2016.08)

(56) References Cited

U.S. PATENT DOCUMENTS 4,590,105 A * 5/1986 Shaffer ..... A47G 33/06 156/61
4,806,957 A * 2/1989 Beegan ..... B41J 2/395 29/854
4,984,999 A * 1/1991 Leake ..... F21V 21/002 439/419
5,117,757 A * 6/1992 Marks ..... B29C 53/581 102/287
5,868,490 A * 2/1999 Barthelmess ..... F21S 4/10 362/227
5,941,626 A * 8/1999 Yamuro ..... F21S 4/10 362/240
5,944,408 A * 8/1999 Tong ..... F21S 4/10 362/249.15
6,126,298 A * 10/2000 Wu ..... F21S 4/10 362/227
6,352,353 B1 * 3/2002 Liu ..... F21S 4/10 362/227
6,388,195 B1 * 5/2002 Studer ..... H01B 3/427 174/120 R
7,901,263 B2 * 3/2011 Tsai ..... F21S 4/10 445/23
8,397,381 B2 * 3/2013 Tsai ..... F21K 9/00 29/561
2002/0167808 A1 * 11/2002 Pan ..... F21S 4/10 362/249.16
2004/0109309 A1 * 6/2004 Chen ..... F21S 4/10 362/122
2004/0130895 A1 * 7/2004 Wu ..... A47G 33/06 362/249.06
2005/0254231 A1 * 11/2005 Wu ..... F21S 4/20 362/123
2006/0146529 A1 * 7/2006 Ho ..... F21K 9/00 362/235
2007/0029572 A1 2/2007 Han et al.
2007/0053192 A1 * 3/2007 Copeland ..... B29C 53/587 362/431
2007/0058363 A1 * 3/2007 Copeland ..... B29C 53/587 362/145
2008/0200089 A1 * 8/2008 Tsai ..... F21S 4/10 445/35
2008/0264671 A1 * 10/2008 Kenny ..... H01B 7/1805 174/120 SR
2010/0157598 A1 * 6/2010 Tsai ..... F21V 19/0015 362/249.01
2010/0195332 A1 * 8/2010 Wasem ..... F21S 2/00 362/249.16
2011/0007509 A1 * 1/2011 Hayes ..... B29C 33/38 362/249.14
2011/0034101 A1 2/2011 Tsai
2011/0085327 A1 * 4/2011 Chen ..... F21S 6/001 362/235
2012/0025260 A1 * 2/2012 Oonakahara ..... H01L 33/62 257/99
2012/0039070 A1 * 2/2012 Shen ..... G02B 6/0006 362/103
2012/0171923 A1 * 7/2012 Hadden ..... A63H 33/006 446/227
2012/0222292 A1 * 9/2012 Velthuis ..... H01F 41/076 29/605
2012/0230031 A1 * 9/2012 Hayes ..... B29C 33/38 362/249.06
2013/0000951 A1 * 1/2013 Honda ..... H01B 3/308 174/120 SR
2015/0362139 A1 * 12/2015 Zheng ..... F21V 23/001 362/249.14
2016/0341408 A1 * 11/2016 Altamura ..... H01L 33/486
2017/0023223 A1 * 1/2017 Tsai ..... F21V 23/06

FOREIGN PATENT DOCUMENTS

CN 2611740 Y 4/2004
CN 104154456 A 11/2014
CN 204213809 U 3/2015

OTHER PUBLICATIONS

European Search Report dated Sep. 9, 2016.
CN Office Action with translation for priority application 201510664702.4.

* cited by examiner

VINE LAMP AND PRODUCTION METHOD THEREOF

CROSS-REFERENCE TO RELATED APPLICATION

The present application claims priority to Chinese patent application 201510664702.4 filed Oct. 14, 2015, which is incorporated herein by reference in its entirety.

TECHNICAL FIELD

The present invention relates to the technical field of illumination, and particularly to a vine lamp and production method thereof.

BACKGROUND ART

Currently, in order for holiday decorations, light strings of traditional LEDs (called light emitting diodes) are made into a lighting decoration product in the form similar to a string of small firecrackers, commonly known as a firecracker lamp. Disadvantages of such the firecracker lamp are: 1. lamp bulbs and lamp sockets on the light strings are large in volume, and conducting wires are relatively thicker, wherein when the number of lamp bulbs in series increases, the entire product has larger volume, resulting in that it is not easy to package and install the product; and 2. the waterproof property of the lamp bulbs and the lamp sockets is poor, therefore putting at risk to use it outdoor, and of course, not suitable to use underwater.

DISCLOSURE OF THE PRESENT INVENTION

An object of the present invention is to provide a vine lamp and a production method thereof to solve the above problems.

The present invention is achieved as follows.

The vine lamp provided by the present invention includes a plurality of light strings, each of which includes a plurality of light emitting components and two conducting wires arranged side by side, wherein each conducting wire comprises a conductor and an insulating layer, which includes a first insulating layer and a second insulating layer, the first insulating layer is wrapped on an outer surface of the conductor, and the second insulating layer is wrapped on an outer surface of the first insulating layer; the insulating layer of each conducting wire is provided with a plurality of openings, portions of the conductor located at the openings form conductor contact surfaces, the openings of two conducting wires are arranged at the positions correspond to each other, the corresponding conductor contact surfaces of the two conducting wires form a conductor contact surface group, on which one light emitting component is welded; and a transparent encapsulation layer is wrapped outside of the openings of the two conducting wires, and the light emitting component and the conductor contact surface group are located the inside of the transparent encapsulation layer to form a lamp bead.

The conducting wire between two adjacent light beads is divided into three sections, which are a first conducting wire section, a second conducting wire section and a third conducting wire section in sequence; the first conducting wire section and the third conducting wire section on both sides of each lamp bead intersect and are winded with each other; and a plurality of the second conducting wire sections of the plurality of light strings intersect and are winded with each other.

Each conducting wire comprises two insulating layers, and each opening is wrapped by the transparent encapsulation layer, so that the entire conducting wire is insulated from the outside through insulating material, which on one hand improves waterproof and insulation properties of the vine lamp for making the vine lamp more suitable for the outdoor decoration, and on the other hand, improves the wear resistance of the vine lamp, prolonging use life; the light emitting components are directly welded to the conductors in the conducting wires, greatly reducing the overall volume of the light string, and a plurality of light strings can be provided as required, meeting use requirements of more occasions, expanding the use range of the vine lamp; meanwhile, the volume of the vine lamp decreases and the mass of the vine lamp becomes lighter, being more convenient for fixation and installation; moreover, the first conducting wire section and the third conducting wire section on both sides of each lamp bead intersect and are winded with each other, making the lamp beads fully exposed, increasing the irradiation range of the lamp beads and achieving a 360°-range irradiation of the lamp beads without a dead angle. It should be noted that the color of the light can be set as the common used light color, such as warm white, white, red, yellow, blue, green, purple, orange and so on.

Further, the first insulating layer is an insulating varnish layer, and the second insulating layer is an insulating resin layer.

In addition to the insulating resin, the second insulating layer can also be of plastic materials such as Teflon, the insulating varnish layer and the insulating resin layer wrapped outside of the conductors further improve the insulation property of the vine lamp, and effectively guarantee safe use of the vine lamp indoor and outdoor.

Further, the light emitting component is a light emitting chip, and the light emitting chip and the conductor contact layer are welded together through a conductive material layer.

The light emitting chip here mainly refers to a LED light emitting chip. The welding mode is applied to the light emitting chips, which not only allows the easy operation, but also reduces as much as possible the overall volume of light strings, so that the vine lamp can be installed more quickly and easily.

Further, both ends of the light emitting chip are provided with "U" shaped notches, in which the conductive material layer is located partially.

Both ends of the light emitting chip are provided with "U" shaped notches, increasing the contact area between the light emitting chip and the conductive material layer, and making the connection between the light emitting chip and the conductor contact surface more firm.

Further, the conductive material layer is of low temperature solder paste or conductive adhesive.

The conductive material layer may be a variety of materials, preferably but not limited to the following two materials, low temperature solder paste and conductive adhesive.

Further, the diameter of each conducting wire is greater than or equal to 0.4 mm.

Due to structural features of the light string in the vine lamp, the diameter of the conducting wire may be greater than or equal to 0.4 mm, such as 0.4 mm, 0.45 mm or 0.5 mm and so on. Compared to the traditional light strings, the volume of the light string of the present invention is reduced by at least 2 times. The vine lamp made of such light strings has good flexibility, allowing users to be able to wind the vine lamp around trees, buildings, furniture or use it to form a lighting decoration such as a curtain lamp or a wreath according to their preferences; meanwhile a plurality of the lamp beads can be added, and a plurality of the light strings can be provided, not only having the beautiful appearance, but also enhancing illumination.

Further, the transparent encapsulation layer has a longitudinal section of elliptical shape.

The encapsulation layer wrapping the light emitting component may be made of translucent or colored material, here preferably the transparent material. The lamp bead formed of the light emitting component wrapped by the transparent encapsulation layer is glittering and translucent. The transparent encapsulation layer is of elliptical shape, achieving a 360° irradiation of the lamp bead without a dead angle, and enhancing intensity of illumination.

Further, the transparent encapsulation layer is made of transparent or translucent resin.

A production method of a vine lamp comprises the following two steps:

a. Step of producing a light string, comprising:

placing two conducting wires side by side in accordance with a preset width;

creating a plurality of openings at corresponding positions on insulating layers of the two conducting wires according to a preset spacing using an optical fiber laser cutting machine, so that conductors at the openings are exposed to outside of the insulating layers to form conductor contact surface groups;

laying a conductive material layer onto the conductor contact surface groups, so that light emitting components are welded to the conductor contact surface groups through the conductive material layer; and wrapping externally the openings of the conducting wires with a transparent encapsulation layer, so that the light emitting components and the conductor contact surface groups are placed inside of the transparent encapsulation layer, to form lamp beads;

b. Step of producing a vine lamp, comprising:

cutting the produced light string according to a predetermined length;

intersecting and winding a first conducting wire section and a third conducting wire section on both sides of each lamp bead, using a numerical control filament winder; and intersecting and winding a plurality of second conducting wire sections of the plurality of light strings using the numerical control filament winder.

The conducting wire comprises a conductor and insulating layers wrapped around the conductor, with the number of the insulating layers of two. During producing the light string in practice, two conducting wires are placed in parallel onto an application tool; a plurality of openings are created sequentially at the same positions on the two conducting wires using the optical fiber laser cutting machine, so that conductors at the openings are exposed to outside of the insulating layers to form the conductor contact surface groups, then a conductive material layer is laid onto the conductor contact surface groups, with the conductive material layer used to achieve the welding between the light emitting components and the conductor contact surface. During the actual welding, the conductor contact surface groups, the light emitting components and the conductor material layer are welded together through being heated by an apparatus, completing the production of the light string. Then, a plurality of the light strings in the predetermined length are selected; the conducting wires on both sides of the lamp bead of each light string are intersected and winded using a numerical control filament winder, and then such produced light strings are intersected and winded using again the numerical control filament winder, completing the production of the vine lamp.

Further, in the step of producing a light string, the light emitting components and the insulating layers are encapsulated by heating and curing the transparent encapsulation layer.

The light emitting components and the insulating layers are encapsulated by heating and curing the transparent encapsulation layer, since there exists seamless welding between the transparent encapsulation layer and the insulating layers of the conducting wires, the vine lamp has better insulation property and waterproof property.

Beneficial effects of the present invention lie in: in the vine lamp provided by the present technical solution, on one hand, a plurality of light strings can be added according to actual requirements, improving intensity of illumination; and on the other hand, the waterproof property, insulating property and plasticity of the vine lamp are quite perfect, with the vine lamp suitable for being installed indoor and outdoor, and even underwater; and compared to conventional light strings, the vine lamp is more practical and meeting people's use requirements.

BRIEF DESCRIPTION OF DRAWINGS

In order to more clearly illustrate embodiments of the present invention or the prior art, below, accompanying drawings used in description of the embodiments will be described briefly. It should be understood that the accompanying drawings in the following only show some embodiments of the present invention and can not be construed as limiting the scope of the present invention. Other drawings can be obtained based on these drawings for those skilled in the art without creative efforts.

REFERENCE SIGNS IN THE FIGURES

Figure 1:
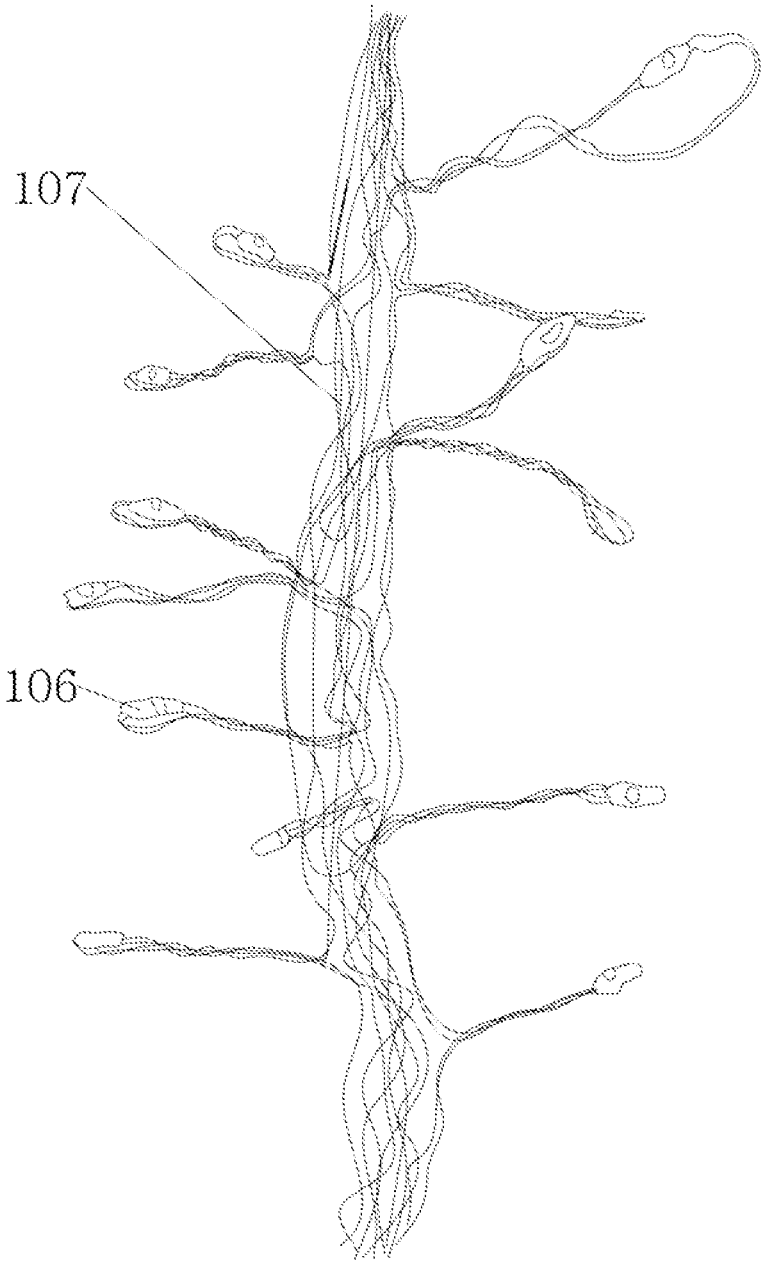
FIG. 1 is an overall structural schematic view of a vine lamp provided by an embodiment of the present invention.

101—light string; 102—conductor; 103—insulating varnish layer;

104—insulating resin layer; 105—transparent encapsulation layer;

106—lamp bead; 107—vine lamp; 108—conductive material layer;

109—light emitting chip; 200—conductor contact surface.

DETAILED DESCRIPTION OF EMBODIMENTS

In order to make the purposes, technical solutions and advantages of embodiments of the present invention more clear, technical solutions of the embodiments of the present invention will be described clearly and completely, in conjunction with accompanying drawings in the embodiments of the present invention. Obviously, the described embodiments are part of the embodiments of the present invention, rather than all embodiments. Generally, components in the embodiments described and illustrated in the drawings herein may be arranged and designed in various configurations.

Therefore, the following detailed description of the embodiments of the present invention provided in the drawings is not intended to limit the protection scope of the present invention, but merely indicate selected embodiments of the present invention. Based on the embodiments of the present invention, all other embodiments obtained by those skilled in the art without creative efforts are within the protection scope of the present invention.

It should be noted that similar reference signs and letters refer to similar items in the following figures, and thus once an item is defined in one figure, it is not necessary to further define and explain it in the subsequent figures.

It should be noted that, in the description of the present invention, terms such as "connection" should be broadly understood, unless otherwise expressed and limited specifically. For example, it may be a fixed connection, or a removable connection, or an integral connection. It may be a mechanical connection or an electrical connection. It may be a direct connection, or an indirect connection through an intermediary, or may be an internal communication between two components. For those skilled in the art, the specific meaning of the above terms in the present invention can be understood depending on specific circumstances.

FIGS. 1 to 6 are referred to, for Embodiment 1.

Figure 2:
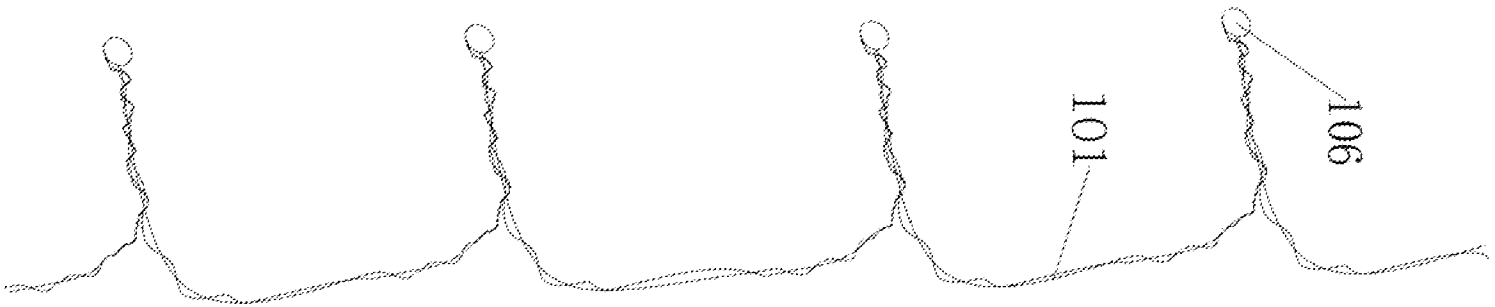
FIG. 2 is a structural schematic view of light strings of the vine lamp provided by the embodiment of the present invention.
Figure 4:
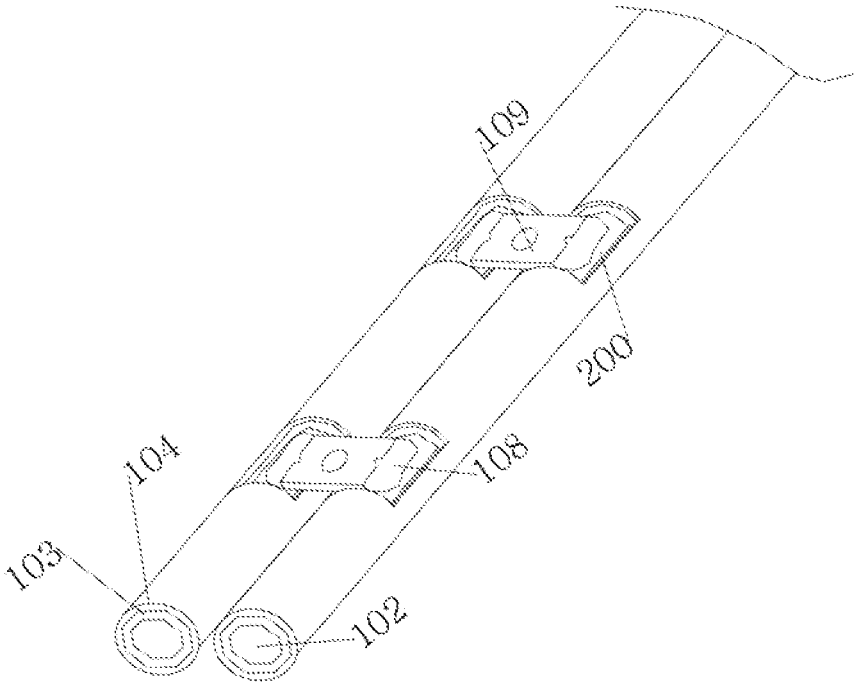
FIG. 4 is a partial structural schematic view of the light string shown in FIG. 2.
Figure 7:
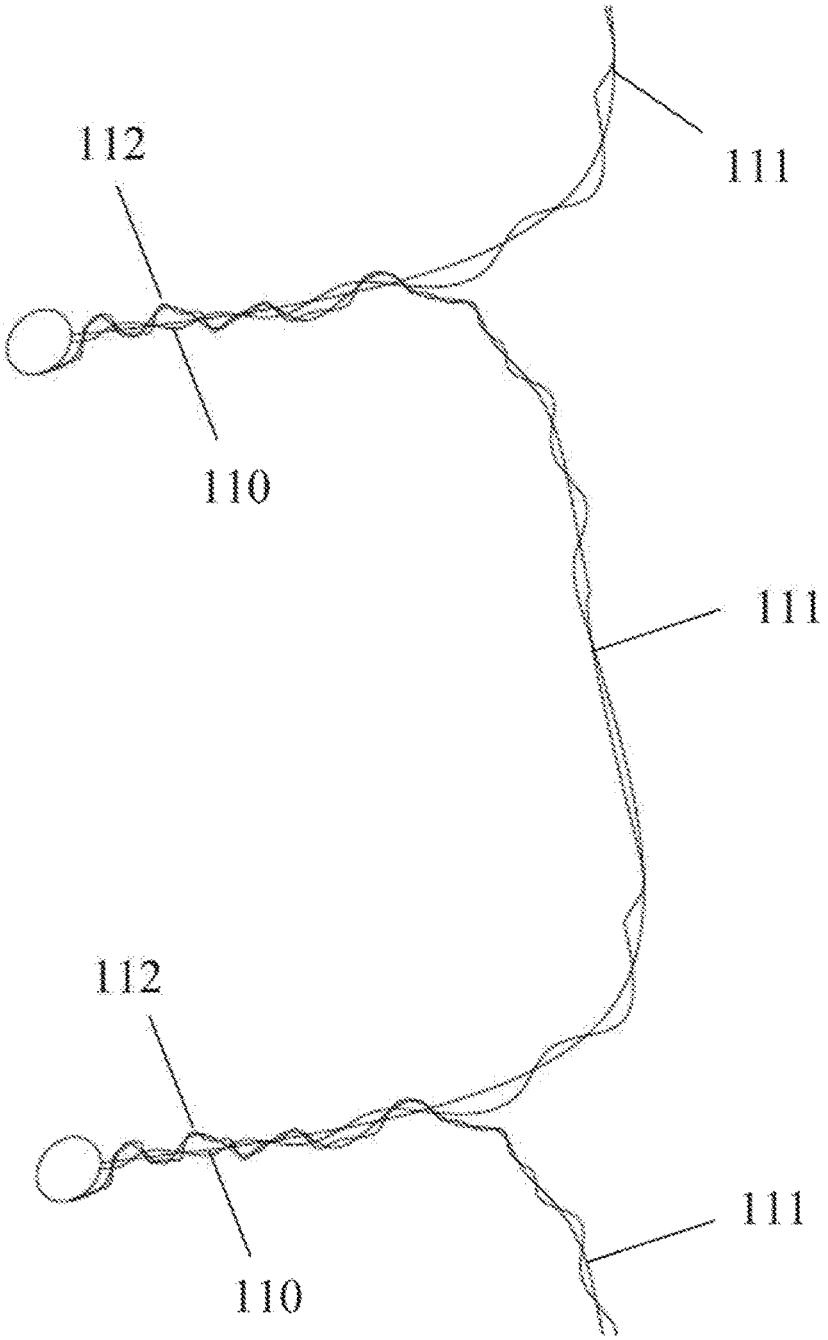
FIG. 7 is a detail view of FIG. 2, showing the first, second, and third conducting wire sections.

A vine lamp 107 provided by this embodiment includes a plurality of light strings 101, as shown in FIG. 4. Each light string 101 includes a plurality of light emitting components and two conducting wires arranged side by side; each conducting wire comprises a conductor 102 and insulating layers, which includes a first insulating layer and a second insulating layer, with the first insulating layer wrapped on an outer surface of the conductor 102, and the second insulating layer wrapped on an outer surface of the first insulating layer. The insulating layer of each conducting wire is provided with a plurality of openings. Portions of the conductor located at the openings form the conductor contact surfaces 200. The openings of two conducting wires are provided at positions corresponding to each other. The corresponding conductor contact surfaces 200 of the two conducting wires form a conductor contact surface group, on which one light emitting component is welded. A transparent encapsulation layer 105 is wrapped outside of the openings of the two conducting wires. The light emitting component and the conductor contact surface group are located inside of the transparent encapsulation layer 105 to form a lamp bead 106. As shown in FIG. 2 and FIG. 7, the conducting wire between two adjacent light beads 106 is divided into three sections, which are a first conducting wire section 110, a second conducting wire section 111 and a third conducting wire section 112 in sequence. The first conducting wire section 110 and the third conducting wire section 112 on both sides of each lamp bead 106 intersect and are winded with each other. As shown in FIG. 1, a plurality of the second conducting wire sections of the plurality of light strings 101 intersect and are winded with each other.

Each conducting wire comprises two insulating layers, and each opening is wrapped by the transparent encapsulation layer 105, so that the entire conducting wire is insulated from the outside through insulating material, which on one hand, improves waterproof and insulation properties of the vine lamp 107 to make the vine lamp more suitable for outdoor decoration, and on the other hand, improves wear resistance of the vine lamp 107 and prolonging use life. The light emitting components are directly welded to the conductors 102 in the conducting wires, greatly reducing the overall volume of the light string 101. A plurality of light strings 101 can be provided as required, meeting use requirements of more occasions and expanding the use range of the vine lamp 107. Meanwhile, the volume of the vine lamp 107 decreases and the mass of the vine lamp 107 becomes lighter, allowing the fixation and installation more convenient. Moreover, the first conducting wire section and the third conducting wire section on both sides of the lamp bead 106 intersect and are winded with each other, making the lamp beads 106 fully exposed, increasing the irradiation range of the lamp beads 106, and achieving a 360° irradiation of the lamp beads 106 without a dead angle. It should be noted that color of the light can be set as the common used light color, such as warm white, white, red, yellow, blue, green, purple, orange and the like.

Figure 3:
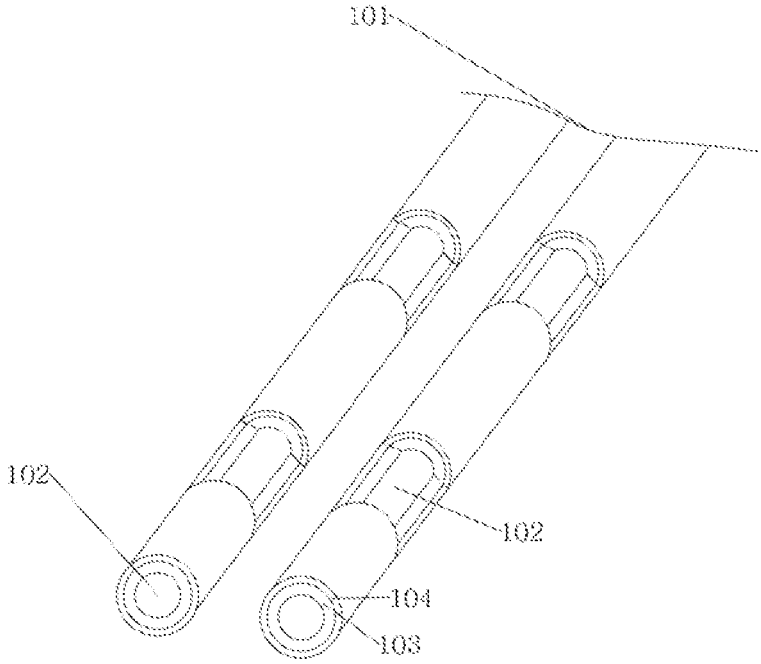
FIG. 3 is a partial structural schematic view of the light string shown in FIG. 2.
Figure 5:
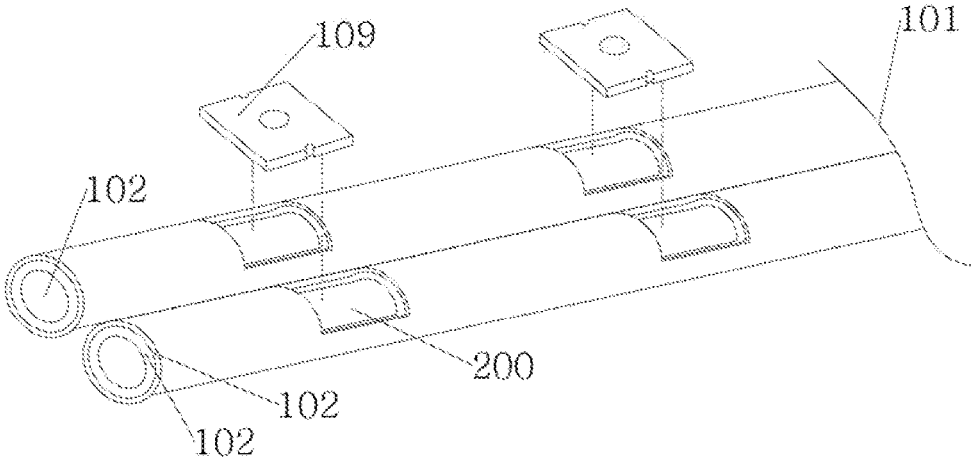
FIG. 5 is a mounting structural schematic view of the light string shown in FIG. 2.

As shown in FIGS. 3 to 5, the first insulating layer and the second insulating layer may be made of a variety of different materials. In the present embodiment, the first insulating layer is preferably an insulating varnish layer 103, and the second insulating layer is preferably an insulating resin layer 104.

Herein, in addition to the insulating resin, the second insulating layer can also be made of the plastic material such as Teflon. The insulating varnish layer 103 and the insulating resin layer 104 being wrapped outside of the conductors 102 further improve the insulation property of the vine lamp 107, and effectively guarantee safe use of the vine lamp 107 indoor and outdoor.

The light emitting component is a light emitting chip 109, as shown in FIG. 5. Both ends of the light emitting chip 109 are provided with "U" shaped notches, in which a conductive material layer 108 is partially located. The conductive material layer 108 is of low temperature solder paste or conductive adhesive.

Here, the light emitting chip 109 mainly refers to a LED light emitting chip 109. The welding mode is applied to the light emitting chips 109, which not only achieves easy operation but also reduces as much as possible the overall volume of light strings 101, so that the vine lamp 107 can be installed more quickly and easily. Both ends of the light emitting chip 109 are provided with "U" shaped notches, increasing the contact area between the light emitting chip 109 and the material layer of the conductor 102, and making the connection between the light emitting chip 109 and the conductor contact surface 200 more firm. The conductive material layer 108 may be of a variety of materials, which include, preferably but not limited to, the following two materials, low temperature solder paste and conductive adhesive.

Due to the above described structural features, the conducting wire in the light string 101 may be thin with the diameter up to 0.4 mm, and of course, the diameter of the conducting wire may be greater than or equal to 0.4 mm, such as 0.4 mm, 0.45 mm or 0.5 mm, and so on. Compared to the traditional light string, the volume of the light string 101 of the present invention is reduced by at least 2 times. The vine lamp 107 made of these light strings 101 has good flexibility, allowing the user to wind the vine lamp 107 around trees, buildings, furniture or use it to form a lighting decoration, such as a curtain lamp or a wreath and the like, according to their preferences. Meanwhile, a plurality of the lamp beads 106 can be added, and a plurality of the light strings 101 can be provided, not only achieving beautiful appearance, but also enhancing illumination.

Herein, the longitudinal section of the transparent encapsulation layer 105 in the lamp bead 106 is of elliptical shape. The encapsulation layer wrapping the light emitting components may be made of translucent or colored material, here preferably, of transparent material. The lamp bead 106 formed of the light emitting components wrapped by the transparent encapsulation layer 105 is glittering and translucent. The transparent encapsulation layer 105 is of elliptical shape, achieving a 360° irradiation of the lamp bead 106 without a dead angle, and enhancing intensity of illumination.

Herein, the transparent encapsulation layer 105 is made of transparent or translucent resin.

FIGS. 1 to 6 are referred to, for Embodiment 2.

Figure 6:
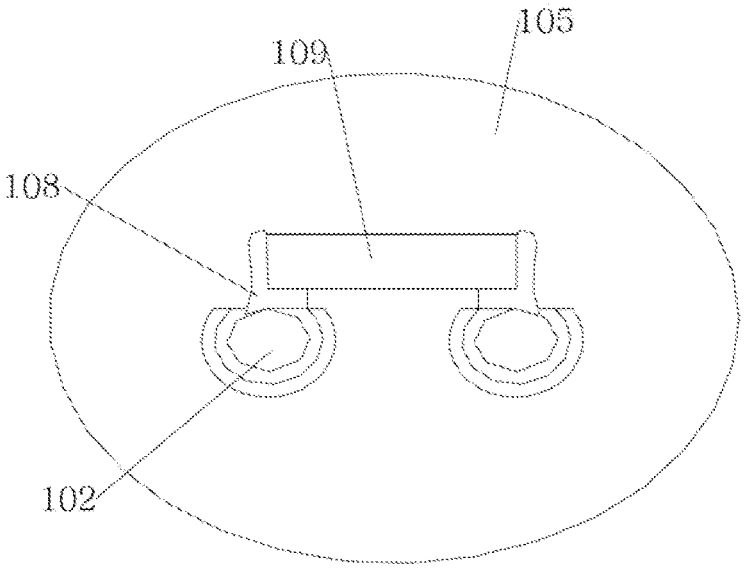
FIG. 6 is a longitudinal cross-sectional schematic view of a lamp bead in the light string shown in FIG. 2.

The method of producing a vine lamp 107 provided by this embodiment comprises the following two steps:

1. FIGS. 3 to 6 are referred to, for the step for producing a light string 101.

a. as shown in FIG. 3, placing two conducting wires side by side in accordance with a preset width; b. as shown in FIG. 3, creating a plurality of openings at corresponding positions on insulating layers of the two conducting wires according to a preset spacing using an optical fiber laser cutting machine, so that conductors 102 at the openings are exposed to the outside of the insulating layers to form the conductor contact surface groups; c. as shown in FIGS. 4 and 5, laying a conductive material layer 108 onto the conductor contact surface groups, so that light emitting components are welded to the conductor contact surface groups through the conductive material layer 108; d. as shown in FIG. 6, wrapping externally the openings of the conducting wires with a transparent encapsulation layer 105, so that the light emitting components and the conductor contact surface groups are placed inside of the transparent encapsulation layer 105 to form lamp beads;

2. Step of producing a vine lamp 107.

a. cutting the produced light string 101 according to a predetermined length; b. as shown in FIG. 2, intersecting and winding a first conducting wire section and a third conducting wire section on both sides of each lamp bead 106 using a numerical control filament winder; and c. as shown in FIG. 1, intersecting and winding a plurality of second conducting wire sections of the plurality of light strings 101 using the numerical control filament winder.

The conducting wire comprises a conductor 102 and insulating layers wrapped around the conductor 102. The number of the insulating layers is two, wherein the first layer is an insulating varnish layer 103 and a second layer is an insulating resin layer 104. Firstly the insulating varnish layer 103 is wrapped outside of the conductor 102, and then the insulating resin layer 104 is wrapped outside of the insulating varnish layer 103. During the actual production of the light string 101, the two conducting wires are placed in parallel on an application tool. A plurality of openings are created sequentially at the same positions on the two conducting wires using the optical fiber laser cutting machine, so that conductors 102 at the openings are exposed to the outside of the insulating layers to form conductor contact surface groups, then a conductive material layer 108 is laid on the conductor contact surface groups, with the conductive material layer 108 used to achieve the welding between the light emitting components and the conductor contact surface 200. During the actual welding, the conductor contact surface groups, the light emitting components and material layer of the conductors 102 are welded together through being heated by an apparatus, completing the production of the light string 101; and then a plurality of the light strings 101 in a predetermined length are selected, the conducting wires on both sides of the lamp bead 106 of each light string 101 are intersected and winded using a numerical control filament winder, and then such produced light strings 101 are intersected and winded using the numerical control filament winder again, completing the production of the vine lamp 107.

Herein, in the step of producing the light string 101, the light emitting components and the insulating layers are encapsulated by heating and curing the transparent encapsulation layer 105. Since there exists seamless welding between the transparent encapsulation layer 105 and the insulating layers of the conducting wires, the vine lamp has better insulation property and waterproof property.

The above description is merely for preferable embodiments of the present invention, but not intended to limit it. The present invention can have various modifications and changes for those skilled in the art. Any modification, equivalent replacement or improvement made within the spirit and principle of the present invention should be included in the protection scope of the present invention.

The invention claimed is:

1. A vine lamp, comprising:

a plurality of light strings, each of which includes a plurality of light emitting components arranged linearly and two conducting wires arranged side by side and extending together sequentially between each adjacent pair of light emitting components and connecting the light emitting components;

wherein each conducting wire comprises a conductor and insulating layers including a first insulating layer and a second insulating layer, the first insulating layer being wrapped on an outer surface of the conductor, and the second insulating layer being wrapped on an outer surface of the first insulating layer;

wherein the first and second insulating layers of each conducting wire are provided with a plurality of openings, portions of the conductor located at the openings forming conductor contact surfaces;

wherein the openings of the two conducting wires are provided at positions corresponding to each other, corresponding conductor contact surfaces of the two conducting wires forming a conductor contact surface group, on which one light emitting component is welded;

wherein a transparent encapsulation layer is wrapped outside of the openings of the two conducting wires, the one light emitting component and the conductor contact surface group being located inside of the transparent encapsulation layer to form a lamp bead;

wherein each conducting wire between two adjacent light beads is divided into a first conducting wire section, a second conducting wire section and a third conducting wire section in sequence;

wherein the first conducting wire section and the third conducting wire section on both sides of each lamp bead intersect and are wound with each other and not with the second conducting wire sections; and wherein each of the second conducting wire sections of the plurality of light strings is wound with one or more other second conducting wire sections of another one of the plurality of light strings.

2. The vine lamp according to claim 1, wherein the first insulating layer is an insulating varnish layer, and the second insulating layer is an insulating resin layer.

3. The vine lamp according to claim 1, wherein the light emitting component is a light emitting chip, and the light emitting chip and the conductor contact surface group are welded together through a conductive material layer.

4. The vine lamp according to claim 3, wherein both ends of the light emitting chip are provided with "U" shaped notches, in which the conductive material layer is located partially.

5. The vine lamp according to claim 3, wherein the conductive material layer is of low temperature solder paste or conductive adhesive.

6. The vine lamp according to claim 1, wherein a diameter of each conducting wire is greater than or equal to 0.4 mm.

7. The vine lamp according to claim 1, wherein a longitudinal section of the transparent encapsulation layer is of elliptical shape.

8. The vine lamp according to claim 1, wherein the transparent encapsulation layer is made of transparent or translucent resin.

9. A method of producing a vine lamp, comprising:

a. a step of producing a light string, comprising:

placing two conducting wires side by side in accordance with a preset width;

creating a plurality of openings at corresponding positions on insulating layers of the two conducting wires according to a preset spacing using an optical fiber laser cutting machine, so that conductors at the openings are exposed to an outside of the insulating layers to form conductor contact surface groups;

laying a conductive material layer onto the conductor contact surface groups, so that light emitting components are welded to the conductor contact surface groups through the conductive material layer; and wrapping externally the openings of the conducting wires with a transparent encapsulation layer, so that the light emitting components and the conductor contact surface groups are placed inside of the transparent encapsulation layer, to form lamp beads;

b. repeating step a to obtain a plurality of produced light strings;

c. a step of producing a vine lamp, comprising:

cutting each produced light string according to a predetermined length;

intersecting and winding a first conducting wire section of the two conducting wires and a third conducting wire section of the two conducting wires on both sides of each lamp bead of each light string using a numerical control filament winder; and intersecting and winding each second conducting wire section of the plurality of produced light strings, each second conducting wire section being between each first conducting wire section and the third conducting wire section on the light strings, with one or more other second conducting wire sections of another one of the plurality of light strings, using the numerical control filament winder.

10. The method of producing the vine lamp according to claim 9, wherein in the step of producing the light string, the light emitting components and the insulating layers are encapsulated by heating and curing the transparent encapsulation layer.

* * * * *